US012520918B1

(12) United States Patent
Wu et al.

(10) Patent No.: US 12,520,918 B1
(45) Date of Patent: Jan. 13, 2026

(54) HANGING UMBRELLA STRUCTURE

(71) Applicant: ZHEJIANG DINGSHENG OUTDOOR LIVING PRODUCTS CO., LTD., Taizhou (CN)

(72) Inventors: Jing Wu, Taizhou (CN); Huanchao Chen, Taizhou (CN); Junhui Zheng, Taizhou (CN)

( * ) Notice: Subject to any disclaimer, the term of this patent is extended or adjusted under 35 U.S.C. 154(b) by 0 days.

(21) Appl. No.: 19/280,217

(22) Filed: Jul. 25, 2025

(30) Foreign Application Priority Data

Jul. 14, 2025 (CN) ..... 202521464214.4

(51) Int. Cl.
*A45B 23/00* (2006.01)
*A45B 25/02* (2006.01)

(52) U.S. Cl.
CPC ..... *A45B 23/00* (2013.01); *A45B 25/02* (2013.01); *A45B 2023/0012* (2013.01); *A45B 2023/0043* (2013.01)

(58) Field of Classification Search
CPC .... A45B 2023/0031; A45B 2023/0043; A45B 2023/0068
See application file for complete search history.

(56) References Cited

U.S. PATENT DOCUMENTS

| | | | | |
|---|---|---|---|---|
| 4,606,366 | A * | 8/1986 | Collet | E04H 12/2253 135/42 |
| 7,520,289 | B1 * | 4/2009 | Barber | A45B 23/00 135/21 |
| 8,281,942 | B2 * | 10/2012 | Meltzer | D06F 57/12 135/21 |
| 9,861,168 | B2 * | 1/2018 | Ma | A45B 23/00 |
| 11,317,689 | B2 * | 5/2022 | He | A45B 23/00 |
| 12,225,989 | B1 * | 2/2025 | Zhao | A45B 17/00 |

FOREIGN PATENT DOCUMENTS

CN 222982593 U 6/2025

* cited by examiner

*Primary Examiner* — Noah Chandler Hawk

(57) ABSTRACT

The present application provides a hanging umbrella structure including a vertical rod, a horizontal arm rod, an umbrella cover skeleton, wherein the umbrella cover skeleton is arranged on the horizontal arm rod, a first connecting rod, a second connecting rod, wherein one end of the first connecting rod and the second connecting rod are correspondingly hinged to two different points on the vertical rod, and the other ends of the first connecting rod and the second connecting rod are correspondingly hinged to two different points on the horizontal arm rod. The vertical rod, the first connecting rod, the second connecting rod and the horizontal arm rod form a deformable quadrilateral structure to adjust an included angle between the horizontal arm rod and the vertical rod, and the quadrilateral structure is provided with a locking mechanism for fixing the included angle between the horizontal arm rod and the vertical rod.

16 Claims, 8 Drawing Sheets

HANGING UMBRELLA STRUCTURE

CROSS-REFERENCE TO RELATED APPLICATIONS

This application claims priority to Chinese Patent Application No. 202521464214.4, titled "HANGING UMBRELLA STRUCTURE", filed on Jul. 14, 2025, the entire disclosure of which is incorporated herein by reference.

TECHNICAL FIELD

The present application relates to the technical field of outdoor products, and in particular to a hanging umbrella structure.

REARGROUND

Outdoor sunshade umbrella is widely used in various outdoor scenes, which not only has the function of sunshade, but also can shelter from wind and rain. Hanging umbrella, also known as side umbrella, is a kind of outdoor umbrella, which realizes the opening and closing of the umbrella surface through a sling mechanism with a crank.

The existing hanging umbrella structure, such as a hand-operated umbrella hanging disclosed in the patent application of CN222982593U, comprises a lower umbrella pole, an upper umbrella pole, a base and a handle; The upper vertical rod is provided with a hand crank and a handle, so that the hand crank and the handle are placed separately, and when winding, the handle on the hand crank is directly rotated to release the pull rope, so that the lower umbrella rod is folded and the umbrella surface (not shown in the figure) is folded. The handle can adjust that position on the upper vertical rod accord to the use condition, so as to adjust the angle of the umbrella surface when the hanging umbrella is spread. The angle adjustment of the umbrella surface of the existing hanging umbrella is mostly realized by the up-and-down movement of the sliding sleeve (that is, the handle) on the vertical rod. However, in the existing hanging umbrella structure, the vertical rod, the horizontal arm and the connecting rod are in a triangular structure, and the angle between the horizontal arm and the connecting rod changes greatly (from acute angle to obtuse angle). In the adjustment process, the resistance at some positions is large, so its structure needs to be further improved.

SUMMARY

This application addresses the limitations of current technology by presenting a hanging umbrella structure with reasonable structure, smooth and labor-saving adjustment of umbrella surface angle.

To achieve the above purpose, the present application adopts the following technical solutions.

In a first aspect, the present application provides a hanging umbrella structure including a vertical rod, a horizontal arm rod, an umbrella cover skeleton, wherein the umbrella cover skeleton is arranged on the horizontal arm rod, a first connecting rod, a second connecting rod, wherein one end of the first connecting rod and the second connecting rod are correspondingly hinged to two different points on the vertical rod, and the other ends of the first connecting rod and the second connecting rod are correspondingly hinged to two different points on the horizontal arm rod. The vertical rod, the first connecting rod, the second connecting rod and the horizontal arm rod form a deformable quadrilateral structure to adjust an included angle between the horizontal arm rod and the vertical rod, and the quadrilateral structure is provided with a locking mechanism for fixing the included angle between the horizontal arm rod and the vertical rod.

The present technical scheme is further set as follows, 2. the locking mechanism comprises a control piece, wherein the control piece is connected with a locking rod and the locking rod is configured to move along the horizontal arm rod; the second connecting rod is provided with a first gear plate at one end close to the horizontal arm rod; and a transmission gear meshed with the first gear plate is arranged in the horizontal arm rod, and a locking tooth matching the transmission gear is arranged at an end of the locking rod. When the locking teeth of the locking rod are engaged with the transmission gear, locking is realized. When the locking teeth of the locking rod are separated from the transmission gear, the quadrilateral structure can be deformed.

The present technical scheme is further set as follows, 3. the locking mechanism comprises a control piece, wherein the control piece is connected with an ejector pin hinged to the horizontal arm rod; a first gear plate is arranged at one end of the second connecting rod close to the horizontal arm rod; and the ejector pin is provided with a rack matching the first gear plate. When the rack is engaged with the first gear plate, locking is realized. When the rack is separated from the first gear plate, the quadrilateral structure can be deformed.

The present technical scheme is further set as follows, an extension section is formed by extending the horizontal arm rod towards the vertical rod, an end of the extension section is provided with a handle, and the control piece is arranged on the handle. The handle is convenient to apply force when adjusting the angle of the horizontal arm, and the control piece is arranged on the handle, which is more convenient to operate and can realize the adjustment operation with one hand.

The present technical scheme is further set as follows, the locking mechanism comprises a control crank arranged on the vertical rod; a driving gear is arranged on the control crank; a transmission gear set is arranged in the vertical rod; a second gear plate is arranged at one end of the second connecting rod close to the vertical rod; and the transmission gear set is meshed with the driving gear and the second gear plate. The rotation of the control crank drives the second connecting rod to rotate, thus realizing the deformation of the quadrilateral structure, and locking is realized by the meshing connection between gears.

The present technical scheme is further set as follows, the hanging umbrella structure is provided with a crank sling mechanism for controlling opening and closing of the umbrella cover skeleton, and the crank sling mechanism comprises a crank and a sling, one end of the sling is wound on the rotating shaft of the crank, and the other end of the sling is connected to the center of the umbrella cover skeleton.

The present technical scheme is further set as follows, the crank is arranged on the horizontal arm rod, and the sling is arranged along the horizontal arm rod and connected to the center of the umbrella cover skeleton.

The present technical scheme is further set as follows, the crank is arranged on the vertical rod, and the sling is arranged along the vertical rod and connected to the center of the umbrella cover skeleton through the first connecting rod and the horizontal arm rod.

The present technical scheme is further set as follows, a telescopic support rod is arranged between the vertical rod and the first connecting rod.

Beneficial Effects of the Present Application

The present application relates to a hanging umbrella structure with reasonable structure, which forms a deformable quadrilateral structure through the vertical rod, the first connecting rod, the second connecting rod and the horizontal arm rod, and realizes the adjustment of the included angle between the horizontal arm rod and the vertical rod, which saves the sliding sleeve structure on the vertical rod in the existing angle adjustment, and increases a degree of freedom compared with the triangular deformation structure in the existing angle adjustment, so that the adjustment is more labor-saving and smooth.

DETAILED DESCRIPTION OF THE EMBODIMENTS

Figure 1:
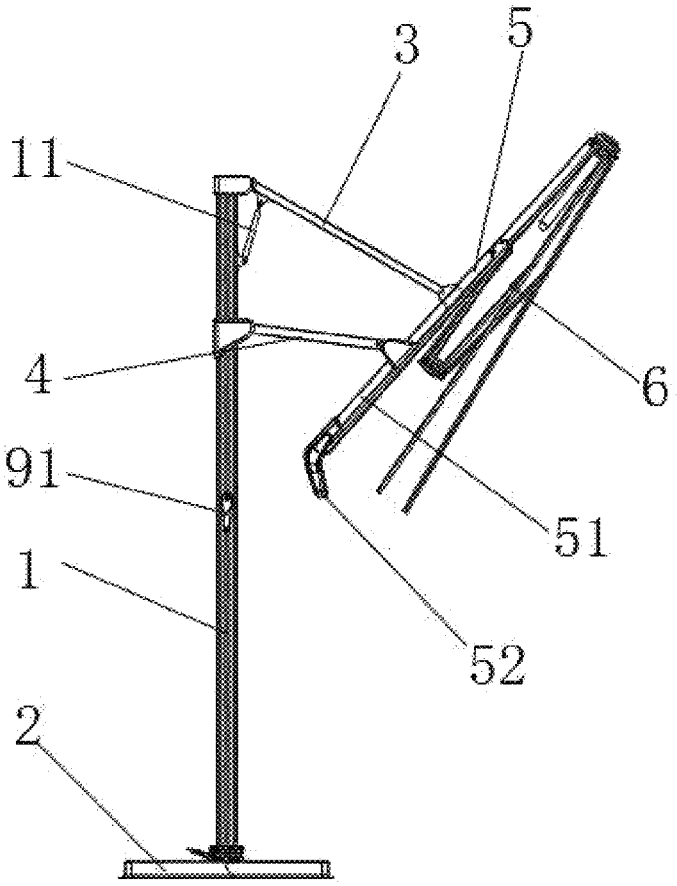
FIG. 1 is a schematic diagram of a first embodiment of the present application.
Figure 2:
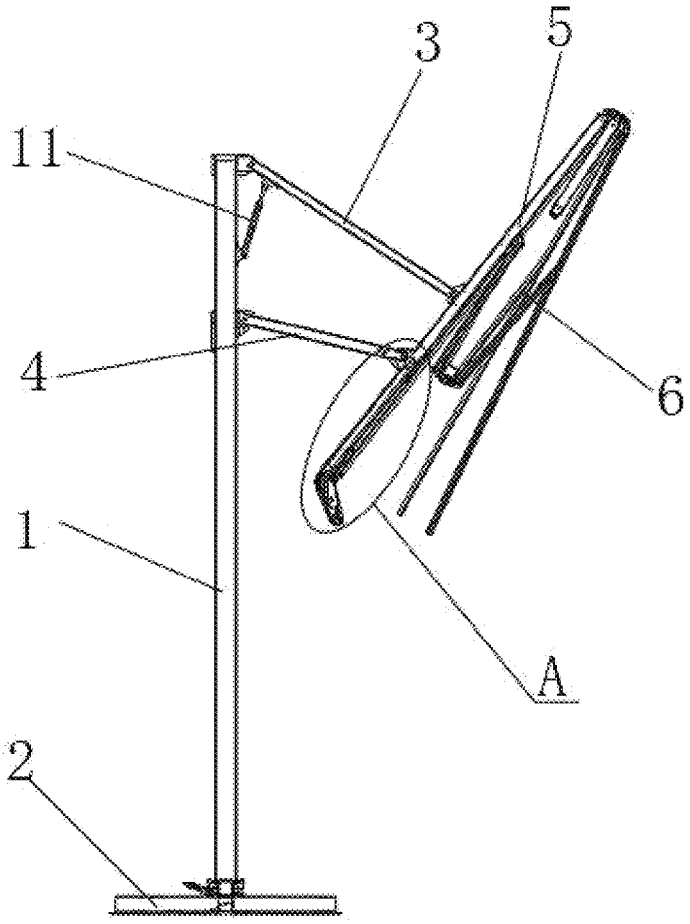
FIG. 2 is a schematic sectional view of the first embodiment of the present application.
Figure 3:
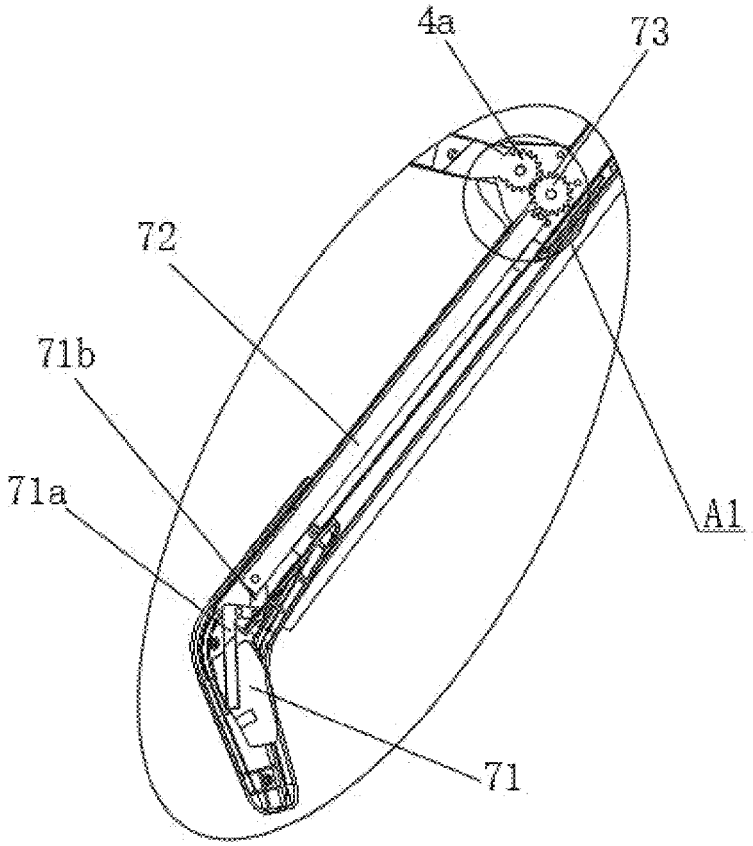
FIG. 3 is an enlarged view of part A in FIG. 2 in an unlocked state.

In order to enable those in the technical field better understand the solutions of the present application, the technical solutions in the embodiment of the present application will be described clearly and completely with the attached drawings. Obviously, the described embodiment is only a part of the embodiment of the present application, but not the whole embodiment. Based on the embodiment in this application, all other embodiment obtained by ordinary technicians in this field without creative work should belong to the protection scope of this application.

It should be understood by those skilled in the art that in the disclosure of the present application, the orientation or positional relationships indicated by the terms "longitudinal", "transverse", "upper", "lower", "left", "right", "front", "rear", "vertical", "horizontal", "top", "bottom", "inner", "outer" and the like are based on the orientation or positional relationships shown in the accompanying drawings. These terms are only used to facilitate the simplified description of the present application, rather than indicating or implying that the referred device or element must have a specific orientation, be constructed and operated in a specific orientation. Therefore, the above terms should not be construed as limiting the present application.

It can be understood that the term "a" should be understood as "at least one" or "one or more", that is, in one embodiment, the number of an element can be one, while in other embodiments, the number of the element can be multiple, and the term "a" cannot be understood as a limitation on the number.

According to a first embodiment of the present application, a hanging umbrella structure is provided, referring to FIGS. 1 to 8, including: a vertical rod 1, a horizontal arm rod 5, an umbrella cover skeleton 6, wherein the umbrella cover skeleton 6 is arranged on the horizontal arm rod 5, a first connecting rod 3, and a second connecting rod 4, wherein one end of the first connecting rod 3 and one end of the second connecting rod 4 are correspondingly hinged to two different points on the vertical rod 1, and the other ends of the first connecting rod 3 and the other ends of the second connecting rod 4 are correspondingly hinged to two different points on the horizontal arm rod 5; and the vertical rod 1, the first connecting rod 3, the second connecting rod 4 and the horizontal arm rod 5 form a deformable quadrilateral structure to adjust an included angle between the horizontal arm rod 5 and the vertical rod 1, and the quadrilateral structure is provided with a locking mechanism for fixing the included angle between the horizontal arm rod 5 and the vertical rod 1. The bottom end of the vertical rod 1 is fixed on the base 2.

In this embodiment, the locking mechanism includes a control piece 71, wherein the control piece 71 is connected with a locking rod 72 and the locking rod is configured to move along the horizontal arm rod 5, the second connecting rod 4 is provided with a first gear plate 4*a* at one end close to the horizontal arm rod 5, and a transmission gear 73 meshed with the first gear plate 4*a* is arranged in the horizontal arm rod 5, and a locking tooth 72*a* matching the transmission gear 73 is arranged at an end of the locking rod 72.

The control piece 71 is provided with a control rod 71*a*, which has an L-shaped structure, and the control rod 71*a* is connected with the end of the locking rod 72 through a connecting piece 71*b* hinged with the horizontal arm rod 5, thereby realizing the connection transmission between the control piece 71 and the locking rod 72. A torsion spring is provided on the hinge shaft between the connecting piece 71*b* and the horizontal arm rod 5 to realize the automatic reset of the control piece 71.

An extension section 51 is formed by extending the horizontal arm rod 5 towards the vertical rod 1, an end of the extension section 51 is provided with a handle 52, and the control piece 71 is arranged on the handle 52. The arrangement of the handle 52 on the extension section 51 makes it easier to operate the deformation of the quadrilateral structure, while the control piece 71 is arranged on the handle 52, which makes the operation more convenient and can realize the adjustment operation with one hand.

A telescopic support rod 11 is arranged between the vertical rod 1 and the first connecting rod 3. The setting of the telescopic support rod 11 can improve the supporting force and stability of the structure.

The hanging umbrella structure is provided with a crank sling mechanism for controlling opening and closing of the umbrella cover skeleton 6, and the crank sling mechanism comprises a crank 91 and a sling 92, one end of the sling is wound on the rotating shaft of the crank 91, and the other end of the sling is connected to the center of the umbrella cover skeleton 6.

Figure 7:
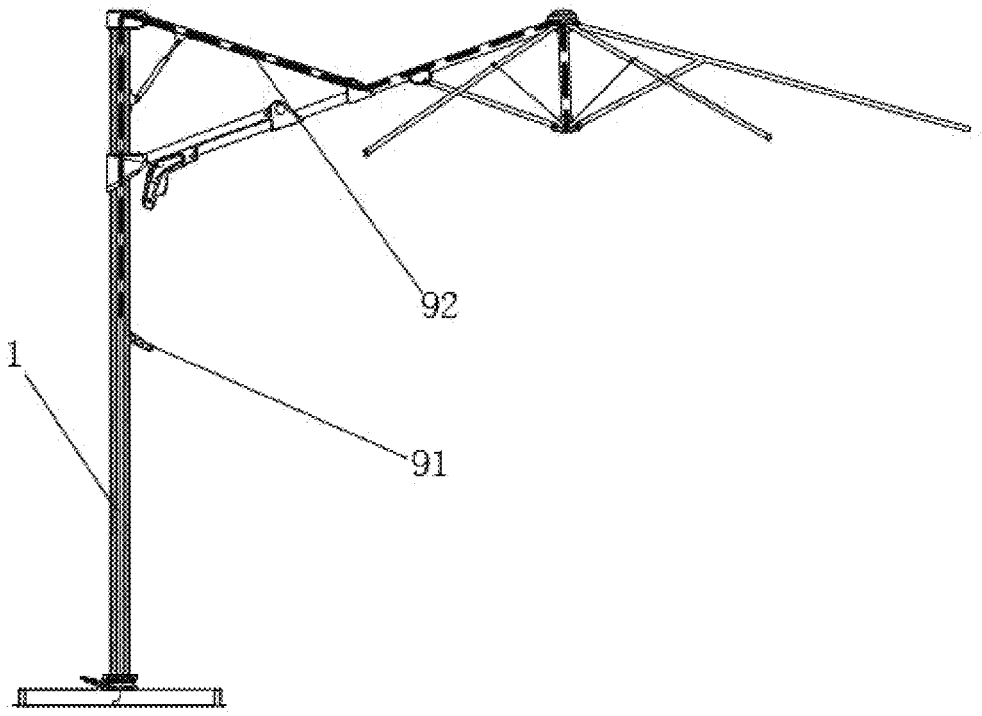
FIG. 7 is a schematic diagram of sling routing of a crank sling mechanism according to a first embodiment of the present application.
Figure 8:
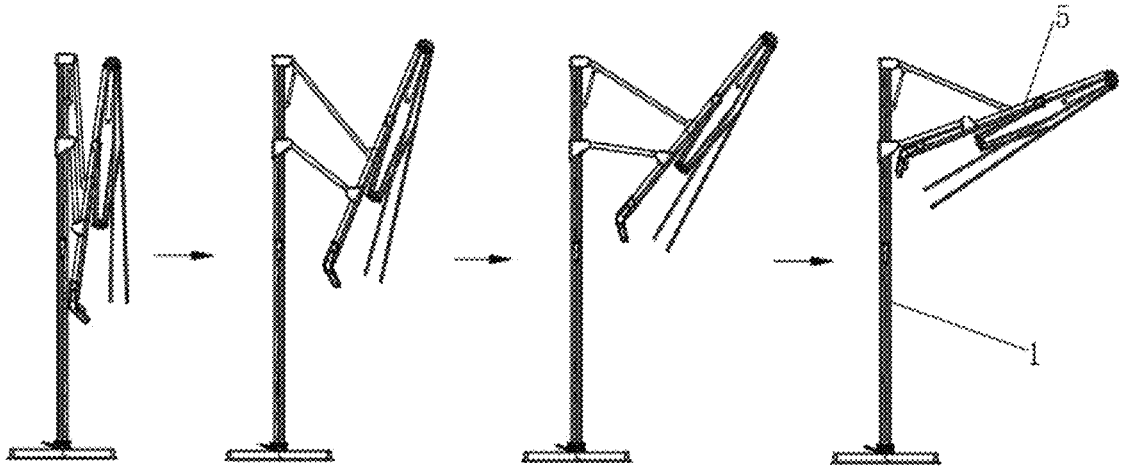
FIG. 8 is a schematic diagram of the angle change of a horizontal arm rob according to a first embodiment of the present application.

As shown in FIG. 7, in this embodiment, the crank 91 is arranged on the vertical rod 1, and the sling 92 is arranged along the vertical rod 1 and connected to the center of the umbrella cover skeleton 6 through the first connecting rod 3 and the horizontal arm rod 5.

The crank sling mechanism is the prior art, and its working principle is the same as that in the existing hanging umbrella, so it will not be described here.

The present application relates to a hanging umbrella structure with reasonable structure, which forms a deformable quadrilateral structure through the vertical rod 1, the first connecting rod 3, the second connecting rod 4 and the horizontal arm rod 5, thus realizing the adjustment of the included angle between the horizontal arm rod 5 and the vertical rod 1, that is, realizing the angle adjustment of the umbrella surface, which omits the sliding sleeve structure on the vertical rod in the existing angle adjustment, and increases a degree of freedom compared with the triangular deformation structure in the existing angle adjustment, making the adjustment more labor-saving and smooth.

Figure 4:
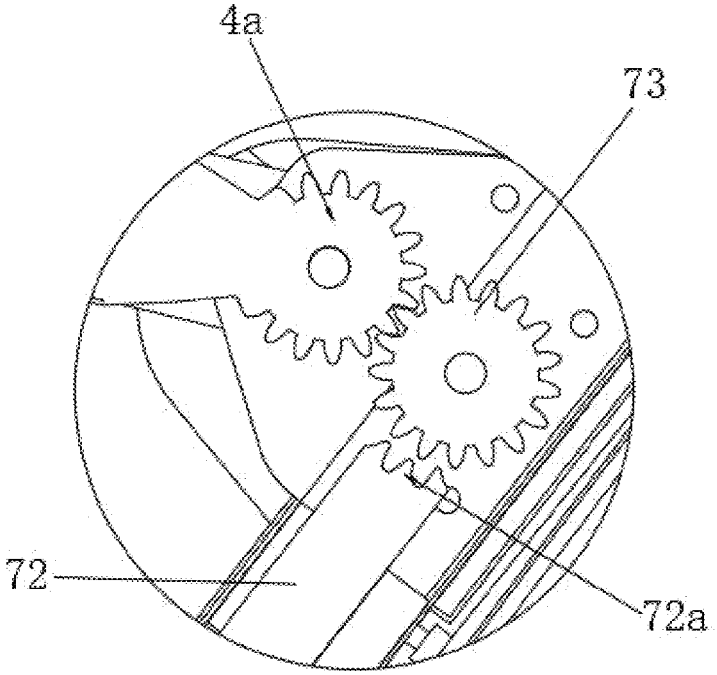
FIG. 4 is an enlarged view of part A1 in FIG. 3.
Figure 5:
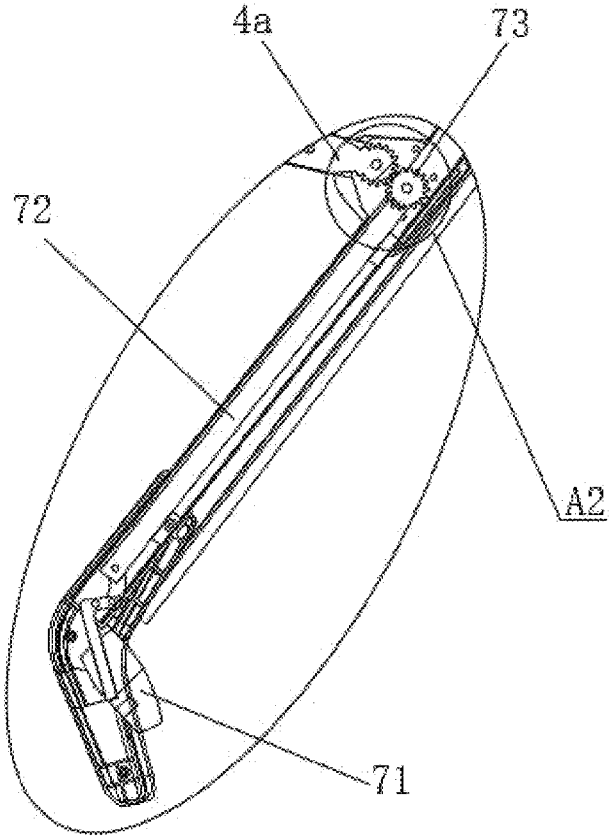
FIG. 5 is an enlarged view of part A in FIG. 2 in a locked state.
Figure 6:
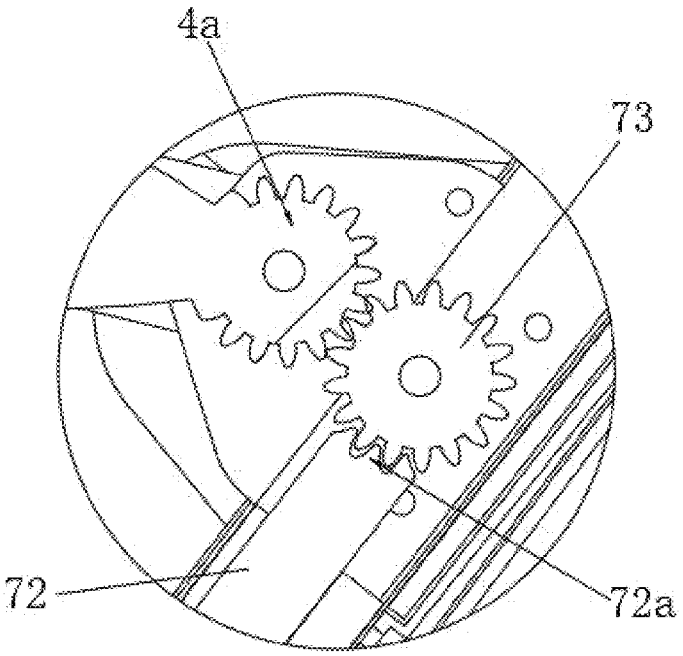
FIG. 6 is an enlarged view of part A2 in FIG. 5.

Working Principle:

After the adjustment of the included angle between the horizontal arm rod 5 and the vertical rod 1 is completed, when the locking tooth 72*a* of the locking rod 72 is engaged with the transmission gear 73, the transmission gear 73 cannot rotate, thereby realizing the locking of the deformable quadrilateral structure formed by the vertical rod 1, the first connecting rod 3, the second connecting rod 4 and the horizontal arm rod 5. For unlocking, it is only necessary to press the control piece 71. The control lever 71*a* of the control piece 71 drives the locking rod 72 to move through the connecting piece 71*b*, so that the locking tooth 72*a* of the locking rod 72 is disengaged from the transmission gear 73 as shown in FIG. 4 to achieve unlocking. At this time, the quadrilateral structure can also be deformed. After the adjustment is completed, release the control piece 71, and the control piece 71 automatically resets, the locking rod 72 moves, and the locking tooth 72*a* of the locking rod 72 is engaged with the transmission gear 73 (as shown in FIG. 6) for locking.

Figure 9:
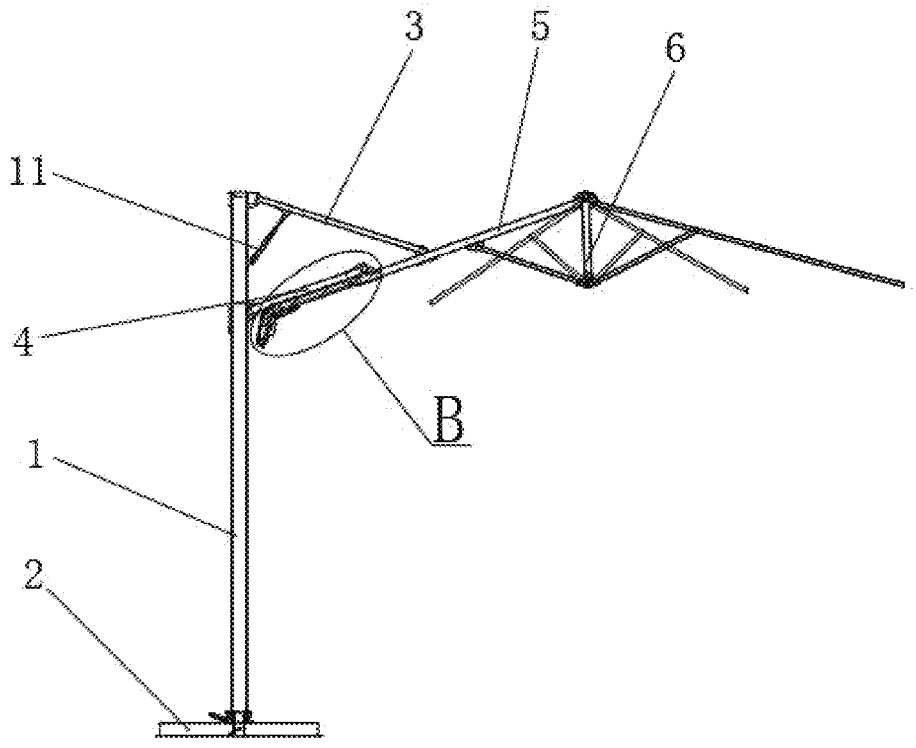
FIG. 9 is a schematic sectional view of a second embodiment of the present application.
Figure 10:
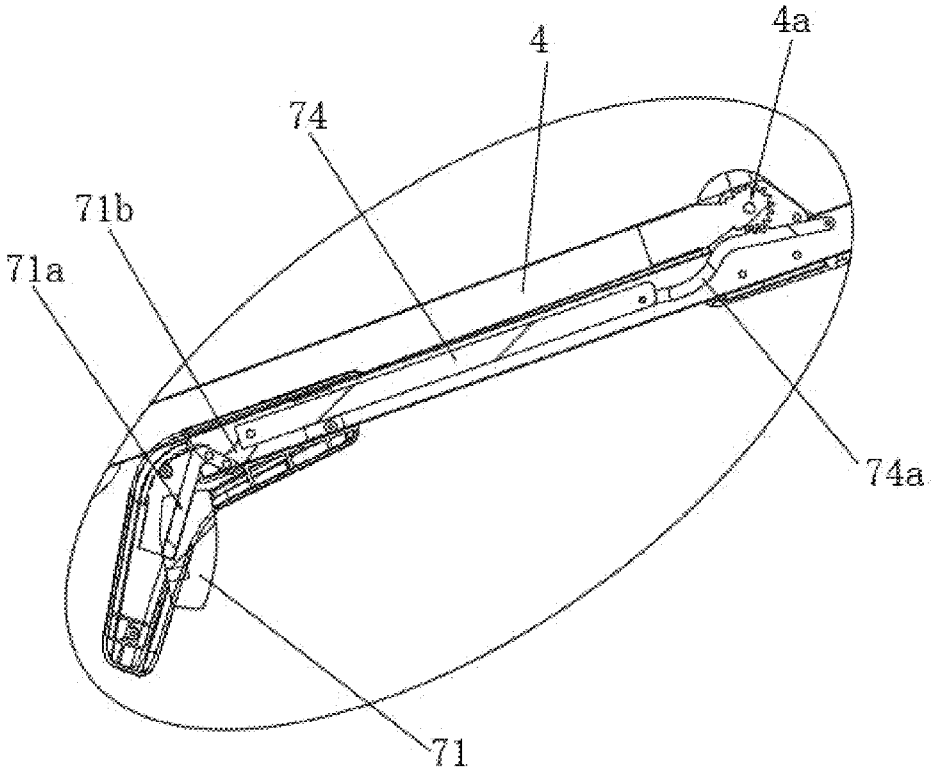
FIG. 10 is an enlarged view of part B in FIG. 9.
Figure 11:
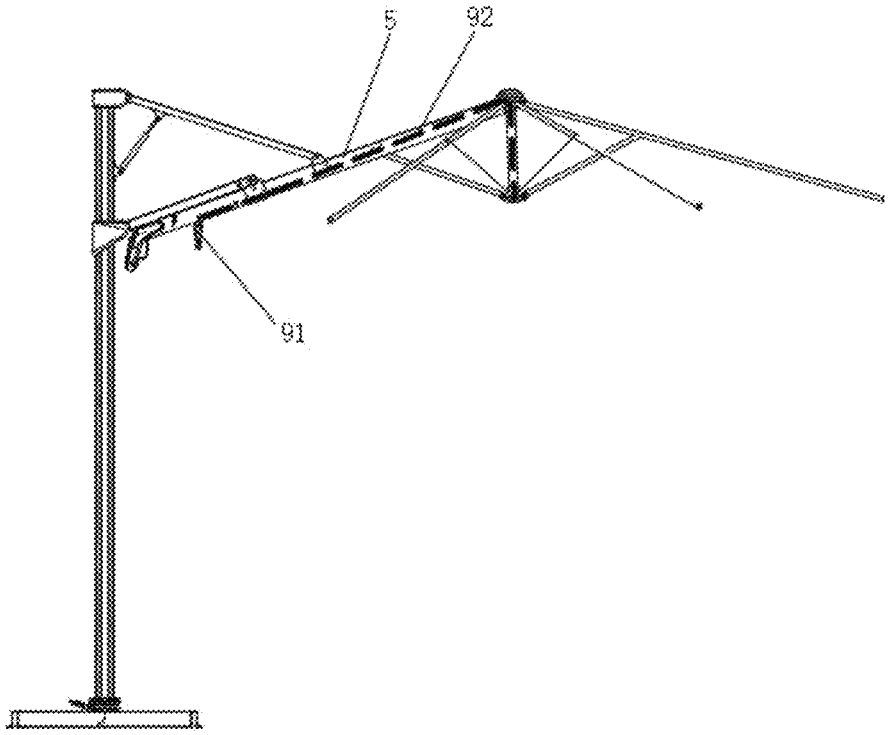
FIG. 11 is a schematic diagram of the sling routing of a crank sling mechanism according to an second embodiment of the present application.

Embodiment 2, as shown in FIGS. 9 to 11, the hanging umbrella structure in this embodiment is similar to that in Embodiment 1, but the difference is that in this embodiment, the locking mechanism includes 3. a control piece 71, wherein the control piece 71 is connected with an ejector pin 74 hinged to the horizontal arm rod 5, a first gear plate 4*a* is arranged at one end of the second connecting rod 4 close to the horizontal arm rod 5; and the ejector pin 74 is provided with a rack 74*a* matching the first gear plate 4*a*.

Similarly, the control piece 71 is provided with a control rod 71*a*, which has an L-shaped structure, and the control rod 71*a* is connected with the end of the locking rod 72 through a connecting piece 71*b* hinged with the horizontal arm rod 5, thereby realizing the connection transmission between the control piece 71 and the locking rod 72. A torsion spring is provided on the hinge shaft between the connecting piece 71*b* and the horizontal arm rod 5 to realize the automatic reset of the control piece 71.

As shown in FIG. 11, in this embodiment, the crank 91 is arranged on the horizontal arm rod 5, and the sling 92 is arranged along the horizontal arm rod 5 and connected to the center of the umbrella cover skeleton 6. In the hanging umbrella structure in this embodiment, the crank sling mechanism in the first embodiment can also be used instead of the crank sling mechanism in this embodiment, that is, the crank 91 is arranged on the vertical rod 1.

As an extension, the crank 91 can be arranged on the handle 52 of the extension section 51 of the horizontal arm rod 5, and its sling 92 is also arranged along the horizontal arm rod 5 and connected to the center of the umbrella cover skeleton 6.

Working Principle:

After the adjustment of the included angle between the horizontal arm rod 5 and the vertical rod 1 is completed, when the rack 74*a* on the ejector pin 74 engages with the first gear plate 4*a*, the locking of the deformable quadrilateral structure formed by the vertical rod 1, the first connecting rod 3, the second connecting rod 4 and the horizontal arm rod 5 is realized. For unlocking, it is only necessary to press the control piece 71, the control lever 71*a* of the control piece 71 drives the ejector pin 74 to rotate around the hinge point through the connecting piece 71*b*, so that the rack 74*a* on the ejector pin 74 is disengaged from the first gear plate 4*a*, thus achieving unlocking.

Figure 12:
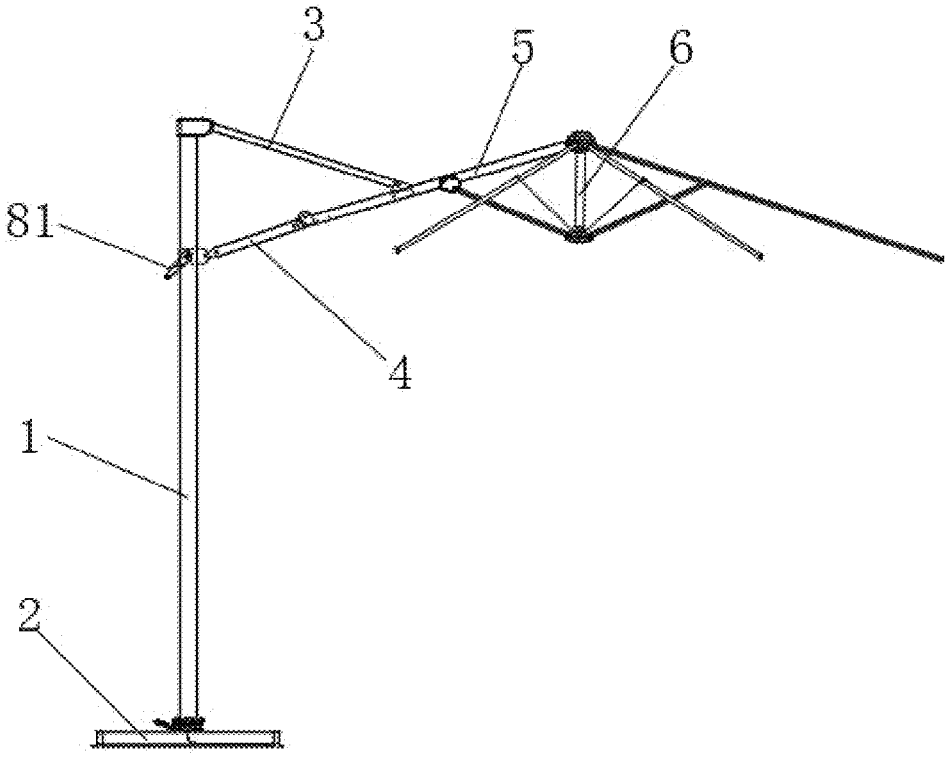
FIG. 12 is a schematic diagram of a third embodiment of the present application.
Figure 13:
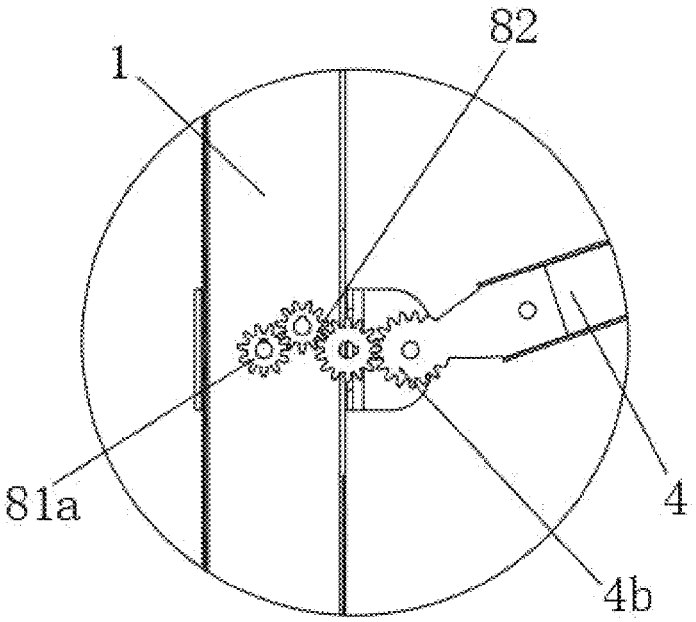
FIG. 13 is is a schematic structural diagram of the locking mechanism according to a third embodiment of the present application.

Embodiment 3, as shown in FIGS. 12 to 13, the hanging umbrella structure in this embodiment is similar to that in Embodiment 1, except that in this embodiment, the locking mechanism includes a control crank 81 arranged on the vertical rod 1, a driving gear 81*a* is arranged on the control crank 81, a transmission gear set 82 is arranged in the vertical rod 1, a second gear plate 4*b* is arranged at one end of the second connecting rod 4 close to the vertical rod 1, and the transmission gear set 82 is meshed with the driving gear 81*a* and the second gear plate 4*b*.

Working Principle:

The rotation of the control crank 81 drives the driving gear 81*a* to rotate, and then the driving gear 81*a* drives the second gear plate 4*b* through the transmission gear set 82, thereby driving the second connecting rod 4 to rotate, so as to realize the deformation of the quadrilateral structure, and the locking is achieved by means of the meshing connection between the gears.

A hanging umbrella structure of the present application has a reasonable structure. It forms a deformable quadrilateral structure through the vertical rod 1, the first connecting rod 3, the second connecting rod 4 and the horizontal arm rod 5, so as to adjust the included angle between the horizontal arm rod 5 and the vertical rod 1. It eliminates the sliding sleeve structure on the vertical rod 1 in the existing angle adjustment, and adds one degree of freedom compared with the triangular deformation structure in the existing angle adjustment, making the adjustment more labor-saving and smooth.

The present application has been described in detail above. The above is only the preferred embodiment of the present application. If the scope of implementation of the present application cannot be limited, that is, all the equal changes and modifications made according to the scope of this application should still fall within the scope of the present application.

What is claimed is:

1. A hanging umbrella structure, comprising:

a vertical rod;

a horizontal arm rod;

an umbrella cover skeleton, wherein the umbrella cover skeleton is arranged on the horizontal arm rod;

a first connecting rod; and a second connecting rod, wherein one end of the first connecting rod and one end of the second connecting rod are correspondingly hinged to two different points on the vertical rod, and the other ends of the first connecting rod and the other ends of the second connecting rod are correspondingly hinged to two different points on the horizontal arm rod; and the vertical rod, the first connecting rod, the second connecting rod and the horizontal arm rod form a deformable quadrilateral structure to adjust an included angle between the horizontal arm rod and the vertical rod, and the quadrilateral structure is provided with a locking mechanism for fixing the included angle between the horizontal arm rod and the vertical rod;

wherein the locking mechanism comprises a control piece, wherein the control piece is connected with a locking rod and the locking rod is configured to move along the horizontal arm rod;

the second connecting rod is provided with a first gear plate at one end close to the horizontal arm rod; and a transmission gear meshed with the first gear plate is arranged in the horizontal arm rod, and a locking tooth matching the transmission gear is arranged at an end of the locking rod.

2. The hanging umbrella structure of claim 1, wherein an extension section is formed by extending the horizontal arm rod towards the vertical rod, an end of the extension section is provided with a handle, and the control piece is arranged on the handle.

3. The hanging umbrella structure of claim 1, wherein the hanging umbrella structure is provided with a crank sling mechanism for controlling opening and closing of the umbrella cover skeleton, and the crank sling mechanism comprises a crank and a sling, one end of the sling is wound on the rotating shaft of the crank, and the other end of the sling is connected to the center of the umbrella cover skeleton.

4. The hanging umbrella structure of claim 3, wherein the crank is arranged on the horizontal arm rod, and the sling is arranged along the horizontal arm rod and connected to the center of the umbrella cover skeleton.

5. The hanging umbrella structure of claim 3, wherein the crank is arranged on the vertical rod, and the sling is arranged along the vertical rod and connected to the center of the umbrella cover skeleton through the first connecting rod and the horizontal arm rod.

6. The hanging umbrella structure of claim 1, wherein a telescopic support rod is arranged between the vertical rod and the first connecting rod.

7. A hanging umbrella structure, comprising:

a vertical rod;

a horizontal arm rod;

an umbrella cover skeleton, wherein the umbrella cover skeleton is arranged on the horizontal arm rod;

a first connecting rod; and a second connecting rod, wherein one end of the first connecting rod and one end of the second connecting rod are correspondingly hinged to two different points on the vertical rod, and the other ends of the first connecting rod and the other ends of the second connecting rod are correspondingly hinged to two different points on the horizontal arm rod; and the vertical rod, the first connecting rod, the second connecting rod and the horizontal arm rod form a deformable quadrilateral structure to adjust an included angle between the horizontal arm rod and the vertical rod, and the quadrilateral structure is provided with a locking mechanism for fixing the included angle between the horizontal arm rod and the vertical rod;

wherein the locking mechanism comprises a control piece, wherein the control piece is connected with an ejector pin hinged to the horizontal arm rod;

a first gear plate is arranged at one end of the second connecting rod close to the horizontal arm rod; and the ejector pin is provided with a rack matching the first gear plate.

8. The hanging umbrella structure of claim 3, wherein the hanging umbrella structure is provided with a crank sling mechanism for controlling opening and closing of the umbrella cover skeleton, and the crank sling mechanism comprises a crank and a sling, one end of the sling is wound on the rotating shaft of the crank, and the other end of the sling is connected to the center of the umbrella cover skeleton.

9. The hanging umbrella structure of claim 8, wherein the crank is arranged on the horizontal arm rod, and the sling is arranged along the horizontal arm rod and connected to the center of the umbrella cover skeleton.

10. The hanging umbrella structure of claim 8, wherein the crank is arranged on the vertical rod, and the sling is arranged along the vertical rod and connected to the center of the umbrella cover skeleton through the first connecting rod and the horizontal arm rod.

11. The hanging umbrella structure of claim 7, wherein a telescopic support rod is arranged between the vertical rod and the first connecting rod.

12. A hanging umbrella structure, comprising:

a vertical rod;

a horizontal arm rod;

an umbrella cover skeleton, wherein the umbrella cover skeleton is arranged on the horizontal arm rod;

a first connecting rod; and a second connecting rod, wherein one end of the first connecting rod and one end of the second connecting rod are correspondingly hinged to two different points on the vertical rod, and the other ends of the first connecting rod and the other ends of the second connecting rod are correspondingly hinged to two different points on the horizontal arm rod; and the vertical rod, the first connecting rod, the second connecting rod and the horizontal arm rod form a deformable quadrilateral structure to adjust an included angle between the horizontal arm rod and the vertical rod, and the quadrilateral structure is provided with a locking mechanism for fixing the included angle between the horizontal arm rod and the vertical rod;

wherein the locking mechanism comprises a control crank arranged on the vertical rod;

a driving gear is arranged on the control crank;

a transmission gear set is arranged in the vertical rod;

a second gear plate is arranged at one end of the second connecting rod close to the vertical rod; and the transmission gear set is meshed with the driving gear and the second gear plate.

13. The hanging umbrella structure of claim 12, wherein the hanging umbrella structure is provided with a crank sling mechanism for controlling opening and closing of the umbrella cover skeleton, and the crank sling mechanism comprises a crank and a sling, one end of the sling is wound on the rotating shaft of the crank, and the other end of the sling is connected to the center of the umbrella cover skeleton.

14. The hanging umbrella structure of claim 13, wherein the crank is arranged on the horizontal arm rod, and the sling is arranged along the horizontal arm rod and connected to the center of the umbrella cover skeleton.

15. The hanging umbrella structure of claim 13, wherein the crank is arranged on the vertical rod, and the sling is arranged along the vertical rod and connected to the center of the umbrella cover skeleton through the first connecting rod and the horizontal arm rod.

16. The hanging umbrella structure of claim 12, wherein a telescopic support rod is arranged between the vertical rod and the first connecting rod.

* * * * *